US008174482B1

(12) United States Patent
Yeung

(10) Patent No.: US 8,174,482 B1
(45) Date of Patent: May 8, 2012

(54) TECHNIQUES TO CONTROL BRIGHTNESS IN A DISPLAY

(75) Inventor: Chun Wun Yeung, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1258 days.

(21) Appl. No.: 11/323,552

(22) Filed: Dec. 31, 2005

(51) Int. Cl.
*G09G 3/36* (2006.01)

(52) U.S. Cl. ..... 345/102; 345/87

(58) Field of Classification Search ..... 345/102, 345/33–52; 315/88–93, 312–315, 209 R; 455/572, 574
See application file for complete search history.

(56) References Cited

U.S. PATENT DOCUMENTS

| | | | | |
|---|---|---|---|---|
| 5,461,547 | A * | 10/1995 | Ciupke et al. | 362/617 |
| 5,760,760 | A * | 6/1998 | Helms | 345/102 |
| 6,030,099 | A * | 2/2000 | McDermott | 362/276 |
| 6,426,736 | B1 * | 7/2002 | Ishihara | 345/102 |
| 7,187,134 | B2 * | 3/2007 | Zipf | 315/209 R |
| 7,215,084 | B1 * | 5/2007 | Sharrah et al. | 315/87 |
| 7,515,223 | B2 * | 4/2009 | Lee et al. | 349/61 |
| 2004/0116161 | A1 * | 6/2004 | Grivas et al. | 455/574 |

* cited by examiner

*Primary Examiner* — Kevin M Nguyen
*Assistant Examiner* — Kenneth B Lee, Jr.

(57) ABSTRACT

A node to receive a first current and to couple a first or a second backlighting medium to the node. The first backlighting medium is to conduct the first current and the second backlighting medium to conduct a second current. A switch is coupled to the node and to the first or the second backlighting medium. The switch is to receive a control input signal and to conduct a third current if the second backlighting medium is coupled to the node.

30 Claims, 7 Drawing Sheets

TECHNIQUES TO CONTROL BRIGHTNESS IN A DISPLAY

BACKGROUND

Communication and computing technologies are starting to converge into a single mobile computing device with continuously decreasing form factors. For example, handheld "smart phones" are emerging that combine capabilities such as voice and data communications typically provided by a cellular telephone with application programs typically provided by a computer. Consequently, a mobile user may use a single device to make telephone calls, maintain calendars and contacts, browse the Internet, communicate electronic mail ("e'mail"), and more.

Mobile computing devices such as handheld smart phones include displays. The displays are often liquid crystal display (LCD) types. LCDs create their display by manipulating visible ambient light. In the absence of ambient light, however, the LCD display is difficult to see. Therefore, backlighting is added to make the LCD displays visible in the absence of ambient light. Backlighting modules that are formed either of a single light emitting diode (LED) or an array of LEDs may be used to create the backlight for small and medium LCD displays, such as those used in mobile computing devices. Advantages of using LEDs for backlighting is low cost, long life, immunity to vibration, low operational voltage, and precise control over intensity. The main drawback of LED backlighting is the increased power consumption relative to other techniques. Power consumption is proportional to the size of the LCD display and may become a major drawback for a large LCD display. For small and medium size color LCDs, LED backlighting may be more efficient than other techniques such as CCFL, and the like.

Converting to a more efficient LED in an existing mobile computing device, however, may not be backwards compatible with existing or legacy devices. In addition, modifications to the system hardware or especially to the low level system software of a mobile computing device may require a wireless carrier approval or certification. This process increases device cost and lead time to market to unacceptable levels. A wireless carrier or a mobile telephone operator is a telephone company that provides wireless telephone services for mobile phone subscribers. A wireless carrier generally requires certification of wireless devices deployed or used in their network. Once a wireless device is approved by a wireless carrier, any modifications to the hardware and software in the wireless device platform may require re-approval or re-certification of the modified wireless device. However, the extent of the re-certification effort depends on what is being modified. Generally, if the modifications entail only minor off-platform changes but not changes at the device platform level (i.e., system hardware and especially low level system software), the approval or certification efforts required may be much lower or even may be eliminated.

Therefore, there is a need for techniques to automatically adjust the brightness level for a backlit LCD display independent of the type of backlighting medium being employed without changing the hardware and/or software of a device platform of legacy devices. New devices that use the same display generally will undergo a normal full scale certification process anyway. Therefore, having a new display in the new device case does not create unacceptable burden for the development process. Moreover, if the modifications can be kept minor, it improves predictability of the performance of the new display in both the legacy and new device platform.

DETAILED DESCRIPTION

Figure 1:
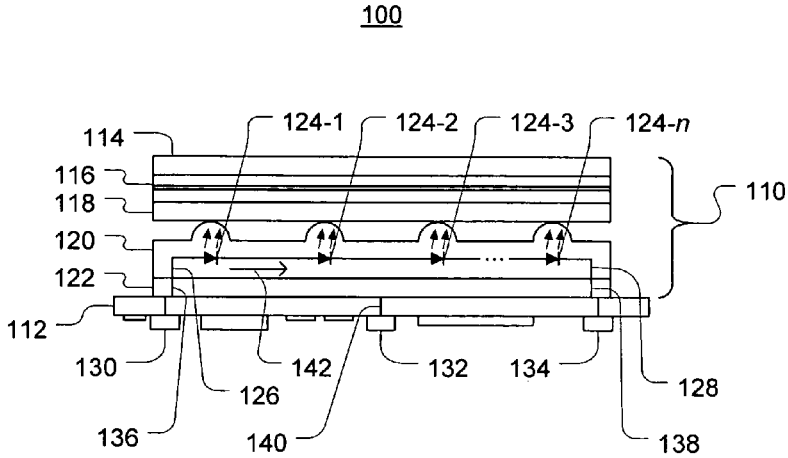
FIG. 1 illustrates one embodiment of a display assembly.

Embodiments of a mobile computing device platform may include some form of backlighting medium to make LCD displays visible independent of ambient light. Such displays are commonly referred to as backlit LCD displays. As used herein, a device platform may comprise, for example, a framework, either in hardware or software, which allows software to run on the device. A typical platform includes computer device architecture, operating system, programming languages, and/or their runtime libraries. In addition, if a new LCD display is not backwards compatible with legacy devices, manufacturers of the devices may have to carry two versions of similar LCD displays, which may compromise operational efficiency, flexibility, increases cost, and inventory burden for the manufacturer.

The backlighting may be provided in a variety of mediums. For example, an LED module comprising a single LED or an array of LEDs may be arranged relative to the LCD display to provide the backlight. The LED backlight may be implemented in array or edge lit configuration. In either configuration the light from the LEDs is focused into a light guide or diffuser to evenly distribute the light behind the viewing area of the LCD display. An array lit configuration includes multiple LEDs uniformly mounted behind the LCD display and provides a more uniform and brighter backlighting relative to the edge lit configuration. The drawback is the increased power consumption resulting from the multiple LEDs. An edge lit configuration may include one or more LEDs mounted to one side (typically the top) and the light is focused edge-on into the light guide or diffuser. Edge lit configurations may be implemented in thinner packages and consume less power than the array configurations because of the fewer number of LEDs used.

Other backlighting mediums may include electroluminescence panel (ELP), cold cathode fluorescent lamp (CCFL), woven fiber, incandescent, pulse width modulated (PWM) LED, among other backlighting mediums.

Although various embodiments are described herein with respect to LED backlighting techniques, the embodiments are not limited in this context and the techniques may be applied to other backlighting techniques. For example, the techniques described herein may be applied to any luminous medium whose luminance is proportional to the current driven through the medium similar to a current driven LED medium. For a luminous medium whose luminance is proportional to the voltage across the medium, i.e., a voltage driven medium, a dimming circuit may be adapted to form a voltage divider rather than a current control as described in the embodiments. Such modifications are intended to be within the scope of the embodiments described herein.

Power consumption is a main concern for battery operated devices. Because the backlighting medium may consume a substantial portion of the total system power in a device, there is a need to minimize the power consumed by the backlighting medium. In a mobile computing device, for example, an LCD backlighting technique utilizing a backlighting medium may consume a large percentage of system power during various modes of operation of the mobile computing device. For a predetermined power consumption (usually based in terms of LED drive current) the backlighting LEDs provide a predetermined level of brightness. A more efficient LED improves the brightness of an LCD display for the same power consumption. In other words, increased brightness for the same LED drive current relative to a less efficient LED. A more efficient LED may be used to generate the same level of brightness as a less efficient LED by reducing the drive current and thus improving overall system power consumption.

Due to the size constraints of mobile computing devices, there are limited signals and input/output terminals available to implement power management and brightness control techniques without modifying the hardware or software platform of the mobile computing device. Further complexities may arise if the mobile computing device includes wireless communication capabilities. For example, as previously discussed, wireless computing devices are subject to approval by a particular wireless carrier in which the wireless device may be deployed or otherwise operated. Wireless carrier approval and certification is a relatively lengthy and costly process. Therefore, once a wireless mobile computing device is approved by a wireless carrier, it is not desirable to modify the wireless mobile computing device hardware or software platform because of the lengthy and costly approval and certification process. In contrast, modifications to off-platform components such as the LCD module generally do not trigger wireless carrier approval and/or certification. Although a carrier may require notification of such off-platform modifications, the probability of a full scale re-certification is substantially low. This may be especially true if the modifications are kept simple, minimal, and unlikely to create a noticeable impact to the radio performance or device reliability, such as, for example, modifications similar to those described herein with respect to the embodiments.

As the demand for more efficient battery operated wireless mobile computing devices increases, there may be a continual need to upgrade legacy devices to include a more energy efficient LCD display backlighting medium, as and when it becomes available, to conserve energy and increase battery life or increase the mean time between charges for rechargeable batteries. For the same current (hence same power consumption) an energy efficient backlighting medium is substantially brighter relative to a reference backlighting medium. It follows that the same brightness may be achieved in an energy efficient backlighting medium relative to the reference backlighting medium for a predetermined decrease in current drive (hence lower power consumption). Therefore, it may be desirable to replace a reference backlighting medium with a higher energy efficient backlighting medium to increase brightness or lower power consumption for the same brightness without modifying the hardware and/or software platform of the underlying device that may trigger full scale approval or certification by a wireless carrier. In addition, it may be desirable to provide an LCD module that automatically adjusts the drive current to the backlighting medium to maintain a relatively consistent level of brightness that is independent of the type of backlighting medium being employed.

FIG. 1 illustrates one embodiment of a display assembly 100. The display assembly 100 may comprise a LCD module 110 coupled to a device platform 112. The LCD module 110 may comprise a touch panel 114, an LCD display 116, a light guide 118 (e.g., a diffusing lightpipe), a backlighting medium 120, and a controller 122. The backlighting medium 120 is coupled to the controller 122. The light guide 118 (e.g., a diffusing lightpipe) is located above the backlighting medium 120. The LCD display 116 is located above the light guide 118. The backlighting medium 120 is optically coupled to the LCD display 116. The backlighting medium 120 makes the LCD display 116 more visible. The touch panel 114 is located above the LCD display 116. In one embodiment, the backlighting medium 120 is optically coupled to the touch panel 114. In one embodiment, the backlighting medium may be an LED type backlighting medium located below the light guide 118. The LED type backlighting medium 120 may comprise one or more LEDs. In one embodiment, the LED backlighting medium 120 may comprise n LEDs 124-1, 124-2, 124-3, **124-*n*, where n may be one to any integer number. The Backlighting medium 120 comprises an anode end 126 and a cathode end 128. In one embodiment, the LEDs 124-1-*n* may be connected in a series circuit configuration, parallel circuit configuration or any combination thereof. In the illustrated embodiment, the LEDs 124-1-*n* are connected in a series circuit configuration. The forward voltage drop across each LED is $V_f$ when a current 142 is driven through each LED 1124-1-*n*. Provided there is an adequate voltage potential applied between the anode end 126 and the cathode end 128, the total forward voltage drop across all the LEDs 124-1-*n*** is n*Vf. Accordingly, the minimum voltage potential applied between the anode end 126 and the cathode end 128 is the sum of the forward voltage $V_f$ across each LED **124-1-*n*** or $n*V_f$. The anode end 126 of the backlighting medium 120 is coupled to the controller 122 and to the device platform 112 via a first node 136. As used herein, a node may be an input or output terminal, connection, junction, lead, and the like. The cathode end 128 of the Backlighting medium 120 is coupled to the controller 122 and to the device platform 112 via a second node 138. The controller 122 applies a voltage potential between the first and second nodes 136, 138 that is greater than the maximum forward voltage drop across LEDs **124-1-*n***, e.g., $>n*V_f$. A third node 140 is provided between the device platform 112 and the controller 122 to set a current 142 based on the type of backlighting medium. The embodiments are not limited in this context.

In one embodiment, the controller 122 may be adapted to automatically control the amount of drive current 142 to the backlighting medium 120. The controller 122 automatically controls the brightness of the backlighting medium 120 by automatically adjusting the current 142 based on the type of the backlighting medium 120 being employed. Accordingly, in one embodiment, the controller 122 may be referred to as an automatic backlighting medium brightness controller. For example, where the backlighting medium 120 is an LED module, the drive current 142 supplied by the controller 122 to the backlighting medium 120 is automatically adjusted based on the type of LED used for the backlighting medium 120. In one embodiment, the controller 122 automatically adjusts the drive current 142 to a first value for one type of backlighting medium and to a second value for another type of backlighting medium to maintain a uniform brightness relative to the type of backlighting medium. In another embodiment, the controller 122 may be adapted to automatically adjust the drive current 142 to any suitable value based on the type of the backlighting medium 120 and the desired brightness or power efficiency. For example, where the backlighting medium 120 is an LED module, the controller 122 may adjust the drive current 142 to a first value for a first LED module type and to a second value for a second LED module type such that the brightness remains constant independent of the backlighting medium or to achieve a relative brightness difference between the two backlighting media, e.g., independent of the first and second LED modules.

As previously discussed, a device platform may comprise, for example, a framework, either in hardware or software, which allows software to run on the device. A platform includes computer device architecture, operating system, programming languages, and/or their runtime libraries. The device platform 112 comprises an anode 130 and a cathode 134. The device platform 112 also provides a control signal node 132 to provide a control signal 140 to the controller 122 to select a backlighting medium. A constant current is supplied to the controller 122 and is sourced from the device platform 112 via the anode 136. The cathode 138 is the return path for the constant current. The control signal 140 adjusts the portion of the constant current that is driven through the backlighting medium 120. Accordingly, the sourced current $I_{source}$ is the maximum current that may be driven through the backlighting medium 120. The device platform 112 may be a portion of any electronic device. In one embodiment, the device platform 112 may be a portion of a mobile computing device platform, for example. In other embodiments, the device platform 112 may be a portion of any device that interfaces with the LCD display 116, for example. The embodiments are not limited in this context.

As previously described with respect to the backlighting medium 120, it may be desirable to replace an existing backlighting LED (e.g., a single LED or an array of two or more LEDs) to a more efficient backlighting LED to reduce the overall power consumption of the device. For example, newer more efficient backlighting LED modules may be formed as drop-in replacements for older less efficient backlighting LED modules. Further, the newer more efficient backlighting LED modules may be backwards compatible with older less efficient backlighting LED modules mechanically, electrically, and in terms of white chromaticity. The relative efficiency between LED modules may be defined in terms of the brightness of the LED relative to the LED drive current 142. Accordingly, a higher efficiency LED module may be brighter than a lower efficiency LED module for the same drive current 142. It follows that the same relative brightness may be achieved if the drive current 142 through the higher efficiency LED modules is lower that the drive current 142 through the lower efficiency LED modules.

As an example, a lower efficiency LED type backlighting medium 120 may be driven with approximately 20 mA of current to achieve a predetermined level of brightness and consumes approximately 288 mW of power. A substantially similar brightness may be obtained with a higher efficiency LED module driven with approximately 12 mA and consumes approximately 173 mW of power. The higher efficiency backlighting medium 120, therefore, consumes approximately 115 mW less power than an equally bright lower efficiency backlighting module 120. If the higher efficiency backlighting medium is driven at 20 mA, then the LCD display will be substantially brighter relative to the lower efficiency backlighting medium 120. The relative difference in brightness, however, may not be acceptable to users of mobile computing devices. Embodiments of the various controllers 122 provided in the LCD module 110 described herein enable the LCD display 116 to have an equivalent level of brightness independent of the efficiency of the backlighting medium 120. This feature also may conserve additional battery power.

The controller 122 automatically adjusts the drive current 142 to the backlighting medium 120 to control the brightness. In one embodiment, automatic adjustment may be implemented by connecting the controller 122 to a predetermined signal that will either enable or disable a current control circuit. One or more pins in the interface may be selected to set distinct states of operation among different devices. In one embodiment, the controller 122 may be implemented as a circuit located or disposed on the LCD module 110 rather than being disposed on the device platform 112. Thus, no modifications may be required to the wireless mobile computing device platform 112 and this minimizes the probability that the device would require recertification or approval by a wireless carrier. As previously discussed, changes to an off-platform component such as the LCD module 110 generally does not require recertification or approval by a wireless carrier if the changes are simple, minimal, and unlikely to create a noticeable impact to the radio performance or device reliability, such as the modifications described in the embodiments.

The control signal 140 from the device platform 112 may be used to select or deselect a current control circuit portion of the controller 122. In various embodiments, the control signal 140 may comprise a tri-state signal and may be a positive signal (e.g., $V_{DD}$, $V_{BATT}$), a negative signal (e.g., $V_{55}$, ground), or may float (e.g., high impedance). A floating control signal 140 acts as though it is completely disconnected from the control signal node 132 or the rest of the circuit. In one embodiment, the $V_{SS}$ and $V_{DD}$ or $V_{BATT}$ definitions may be interchanged on the LCD module 110 interface. For example, in some implementations, the control signal 140 from the LCD module 110 interface is $V_{SS}$ and may be used to switch ON a P-channel metal oxide semiconductor field effect transistor (MOSFET) to enable a current control circuit element. In other embodiments, the control signal 140 from the LCD module 110 interface is $V_{DD}$ and may be used to switch an N-channel MOSFET to enable the current control element. In additional embodiments, the control signal 140 from the LCD module 110 interface may remain floating. The above examples are merely illustrative as the embodiments are not limited in this context.

Because the LEDs **124-1-*n* in the backlighting medium 120 behave in a manner substantially similar to a conventional diode, the forward voltage of each of the LED 124-1-*n* remains substantially constant under substantially constant ambient temperature once the forward voltage $V_f$ exceeds the diode threshold voltage for each LED. Accordingly, a current control circuit element provided in the controller 122 may be used to select a substantially constant current based on the efficiency of the LEDs 124-1-*n* of the backlighting medium 120 to modify the brightness level of the LEDS 124-1-*n*. Accordingly, the backlighting medium 120 may be configured as a backwards compatible drop-in replacement. Embodiments of the controller 122 (described below with reference to FIGS. 2-6) may be implemented such that when a less efficient backlighting medium 120 is used, the current control circuit is disabled and all the current is diverted to it. When a more efficient backlighting medium 120 is used, the current control circuit is enabled and only a suitable portion of the drive current is diverted to the backlighting medium 120 to maintain a uniform substantially similar brightness level relative to the lower efficiency backlighting medium 120. Accordingly, one embodiment may be implemented to maintain backward compatibility without triggering a full scale re-certification by the carrier. Another embodiment may be implemented to provide continual efficiency improvement on new device platforms. For example, to provide a more efficient backlighting medium 120 for a new device platform wherein the hardware and software are still under development. The device platform may be implemented to exploit the efficiency gain and deliver a lower current to the backlighting medium 120** to achieve essentially the same brightness as the legacy devices while disabling the current control circuit.

Embodiments of the controller 122 described herein enable a more efficient backlighting medium 120 to be configured as a backwards compatible drop-in replacement for existing legacy devices without modifying the hardware or software in the device platform 112 of the underlying legacy devices. The more efficient backlighting medium 120 consumes less system power and extends battery life. Although legacy devices may not exploit the improved efficiency of the backlighting medium 120 because the difference in power is consumed through a current control resistor R2 (FIG. 6) and is dissipated as heat. The backward compatibility, however, minimizes the relative brightness variations between high efficiency and low efficiency backlighting media 120 in the legacy platform. It also eliminates the need to carry inventories on two types or versions of otherwise very similar LCD modules 110 and therefore improves manufacturing operational efficiency and flexibility. Accordingly, the controller 122 enables the high and low efficiency backlighting media 120 to be readily swapped and maintain brightness compatibility without modifying the device platform 112. As a result certification and/or approval by a wireless carrier may be eliminated or certification and/or approval time may be substantially shortened for legacy devices. This may improve time to market of mobile computing devices with newer more power efficient features as they evolve.

In other embodiments, the ability to enable and disable a dimming current control circuit via the control signal 140 may be useful in device development because some device life cycles generally overlap. Accordingly, while a device is under development to include the device platform 112 to exploit new, more efficient backlighting medium 120, a version of the device may be released as part of a legacy device prior to completing the qualification/certification process. This may arise because carriers want to be informed about any changes made to legacy devices according to agreed upon schedules. In other words, it is usually not acceptable for a manufacturer to make individual changes to a device without informing the carrier. Therefore, a current control circuit may be enabled in a legacy device in order to deploy the device with the more efficient backlighting medium 120 before it is fully qualified for operation in the new device platform 112.

Figure 2:
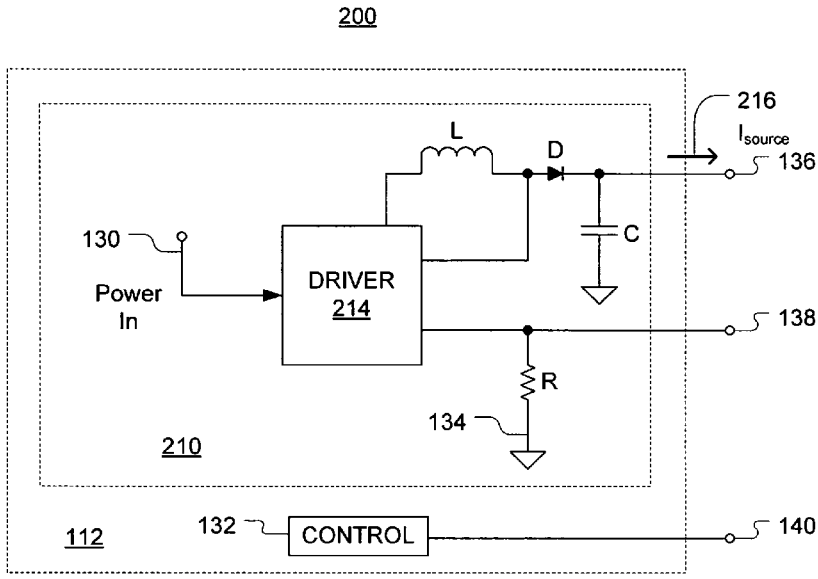
FIG. 2 illustrates one embodiment of an interface between an automatic brightness current controller and a device platform.

FIG. 2 illustrates one embodiment of an interface 200 between the automatic brightness current controller 122 and the device platform 112. In one embodiment, the interface 200 may be disposed or located on the device platform 112. The anode 130 may be a power input terminal to supply power to a driver module, for example. In one embodiment, the power input anode 130 may receive a positive supply voltage such as $V_{DD}$, for example. The cathode 134 may be coupled to ground or to $V_{SS}$. The control node 132 controls the drive current to the backlighting medium 120 based on the control signal 140 provided to the controller 122. The interface 200 also comprises a driver module 210. In one embodiment, the driver module 210 comprises a driver 214 to drive the backlighting medium 120. In one embodiment, the driver 214 receives power at the anode 130 and sources a substantially constant $I_{source}$ current 216 from the first node 136 and back into the third node 138. It will be appreciated, that in other implementations the $I_{source}$ current 216 may be sourced from the third node 138 without departing from the scope of the embodiments. In other implementations, current may be sinked into either one of the first or second nodes 136, 138 without departing from the scope of the embodiments. Those skilled in the art will appreciate that with respect to the controller 122, the first and second nodes 136, 138, whether they source or sink current, look like a constant current source to the controller. The driver module 210 also may include protection and conditioning elements L, D, R, and C, for example. The embodiments are not limited in this context.

Figure 3:
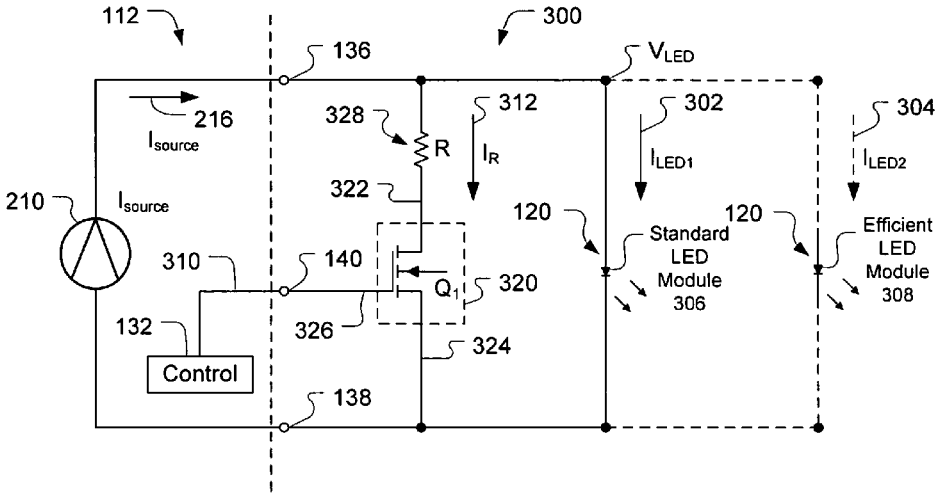
FIG. 3 illustrates one embodiment of an automatic backlighting medium brightness current controller.

FIG. 3 illustrates one embodiment of an automatic backlighting medium 120 brightness current controller 300. The controller 300 is coupled to the first node 136 to receive a constant current $I_{source}$ 216. The controller 300 comprises a switch 320 coupled to the first node 136. The switch 320 comprises an input terminal 322 coupled to a first end of a load 328, an output terminal 324 coupled to the second node 138, and a control input 326 coupled to the third node 140. A second end of the load 328 is coupled to the first node 136. The backlighting medium 120 is coupled between the first and second nodes 136, 138. The control signal 310 is applied to the third node 140 and is coupled to the control input 326 of the switch 320. The control signal 310 controls the state of the switch 320. When the switch 320 is in the OFF state, the entire current supplied by the constant current source, the $I_{source}$ current 216, is driven through the backlighting medium 120. When the switch 320 is in the ON state and conducts, a current $I_R$ is driven through the load 328 and the current through the backlighting medium 120 is reduced by an amount equal to $I_R$. The control signal 310 controls the state of the switch 320 based on the type of the backlighting medium 120 coupled between the first and second nodes 136, 138. In one embodiment, the switch 320 is an N-channel MOSFET transistor $Q_1$. In other embodiments, the switch 320 may be any suitable type of semiconductor switch.

The driver module 210 provides the $I_{source}$ current 216 to the controller 300 from the first node 136. As previously discussed, in one embodiment, the $I_{source}$ current 216 is a constant current source. A control signal 310 from the third node 140 controls whether to switch the transistor $Q_1$ ON or OFF based on the type of backlighting medium 120 placed in the LCD module 110. The transistor $Q_1$ is biased as a switch that conducts when it is ON and does not conduct when it is off. For example, in one embodiment the current may be set based on the efficiency of the backlighting medium 120 LED module. In the illustrated embodiment, the control signal 310 controls whether to switch the transistor $Q_1$ ON or OFF based on the backlighting medium 120 LED module type, e.g., a standard LED module 306 (shown in solid line) or an efficient LED module 308 (shown in dashed line). The $I_{source}$ current 216 may be selected as the current required to achieve a level of brightness of the standard backlighting LED module 306. Accordingly, in one embodiment, if the backlighting medium 120 is a standard LED module 306 then the entire $I_{source}$ current 216 may be used to drive the standard LED module 306. If the backlighting medium 120 is the standard LED module 306, then the control signal 310 is set low and the transistor $Q_1$ is turned off. The entire $I_{source}$ current 216 is driven through the standard LED module 306 and the $I_{LED1}$ current 302 is equal to the $I_{source}$ current 216 and, therefore, the $I_R$ current 312 is zero. If the backlighting medium 120 is the efficient LED module 308, the $I_{LED2}$ current 304 should be less than the $I_{source}$ current 216 to maintain the same level of brightness achieved with the standard LED module 306. Accordingly, the control signal 310 is set high and the transistor Q is turned ON to sink the $I_R$ current 312. The $I_R$ current 312 may be defined approximately as:

$$I_R \approx V_{LED}/R$$

Where R is the load resistance in series with the drain of the transistor $Q_1$, and the $V_{LED}$ voltage is the forward voltage of the efficient LED module 308, which remains substantially constant, and the voltage between drain and source $V_{DS}$ of the transistor $Q_1$ is assumed to be substantially zero. If the $V_{LED}$ voltage remains substantially constant then the $I_R$ current 312 also remains substantially constant. Accordingly, the $I_{LED2}$ current 304 through the efficient LED module 308 remains substantially constant and may be defined approximately as:

$$I_{LED2} \approx I_{source} - I_R$$

Figure 4:
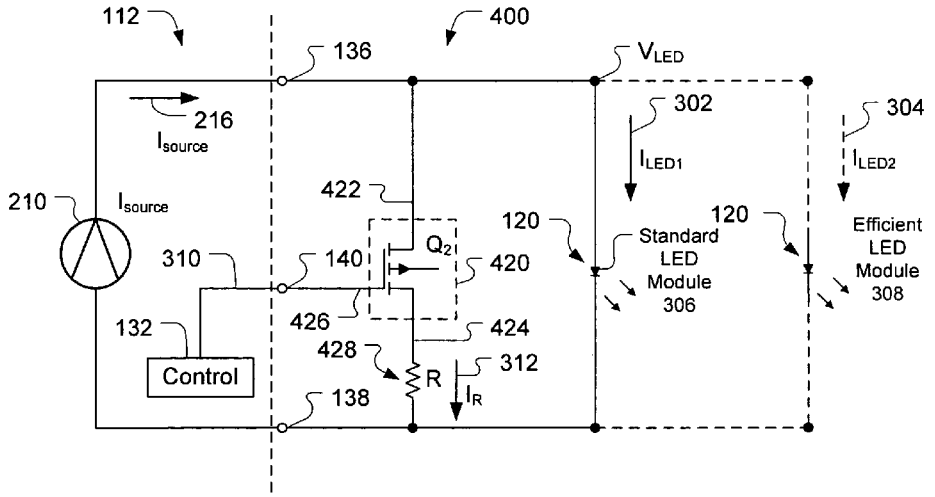
FIG. 4 illustrates one embodiment of an automatic backlighting medium brightness current controller.

FIG. 4 illustrates one embodiment of an automatic backlighting medium 120 brightness current controller 400. The controller 400 is coupled to the first node 136 to receive a constant current $I_{source}$ 216. The controller 400 comprises a switch 420 coupled to the first node 136. The switch 420 comprises an input terminal 422 coupled to a first end of a load 428, an output terminal 424 coupled to the second node 138, and a control input 426 coupled to the third node 140. A second end of the load 428 is coupled to the first node 136. The backlighting medium 120 is coupled between the first and second nodes 136, 138. The control signal 310 is applied to the third node 140 and is coupled to the control input 426 of the switch 420. The control signal 310 controls the state of the switch 420. When the switch 420 is in the OFF state, the entire current supplied by the constant current source, the $I_{source}$ current 216, is driven through the backlighting medium 120. When the switch 420 is in the ON state and conducts, a current $I_R$ is driven through the load 428 and the current through the backlighting medium 120 is reduced by an amount equal to $I_R$. The control signal 310 controls the state of the switch 420 based on the type of the backlighting medium 120 coupled between the first and second nodes 136, 138. In one embodiment, the switch 420 is a P-channel MOSFET transistor $Q_2$. In other embodiments, the switch 420 may be any suitable type of semiconductor switch.

The driver module 210 provides the $I_{source}$ current 216 to the controller 400 from the first node 136. The control signal 310 from the third node 140 controls whether to switch the transistor $Q_2$ ON or OFF based on the type of backlighting medium 120 employed in the LCD module 110. The transistor $Q_2$ is biased as a switch that conducts when it is ON and does not conduct when it is OFF. For example, in one embodiment the current may be set based on the efficiency of the backlighting medium 120 LED module. In the illustrated embodiment, the control signal 310 controls whether to switch the transistor $Q_2$ ON or OFF based on the backlighting medium 120 LED module type, e.g., the standard LED module 306 (shown in solid line) or the efficient LED module 308 (shown in dashed line). The $I_{source}$ current 216 is the current required to achieve the level of brightness of the standard backlighting LED module 306. Accordingly, in one embodiment, if the backlighting medium 120 LED module is the standard LED module 306 then the entire $I_{source}$ current 216 is used to drive the standard LED module 306. If the backlighting medium 120 is the standard LED module 306, then the control signal 310 is set high and the transistor $Q_2$ is turned off. The entire $I_{source}$ current 216 is driven through the standard LED module 306 and the $I_{LED1}$ current 302 is equal to the $I_{source}$ current 216 and, therefore, the $I_R$ current 312 is zero. If the backlighting medium 120 is the efficient LED module 308, the $I_{LED2}$ current 304 should be less than the $I_{source}$ current 216 to maintain the same level of brightness achieved with the standard LED module 306. Accordingly, the control signal 310 is set low and the transistor $Q_2$ is turned ON to sink the $I_R$ current 312. The $I_R$ current 312 may be defined approximately as:

$$I_R \approx V_{LED}/R$$

Where R is the load resistance in series with the drain of the transistor $Q_2$, and the $V_{LED}$ voltage is the forward voltage of the efficient LED module 308, which remains substantially constant, and the voltage between drain and source $V_{DS}$ of the transistor $Q_2$ is assumed to be substantially zero. If the $V_{LED}$ voltage remains substantially constant, then the $I_R$ current 312 also remains substantially constant. Accordingly, the $I_{LED2}$ current 304 through the efficient LED module 308 remains substantially constant and may be defined approximately as:

$$I_{LED2} \approx I_{source} - I_R$$

Figure 5:
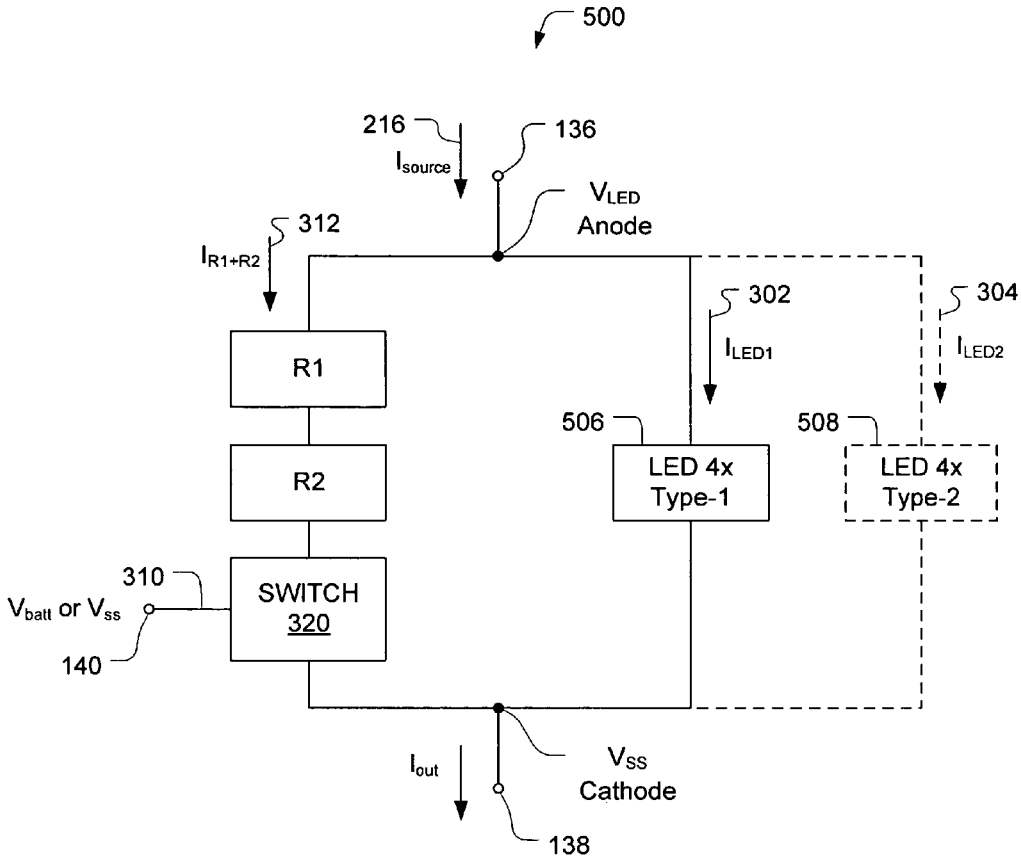
FIG. 5 illustrates one embodiment of an automatic backlighting medium brightness current controller.

FIG. 5 illustrates one embodiment of an automatic backlighting medium 120 brightness current controller 500. The driver module 210 provides the $I_{source}$ current 216 to the controller 500 from the first node 136. The control signal 310 from the third node 140 controls whether to set the switch 320 (e.g., N-Channel MOSFET transistor $Q_1$) in the ON state (conduction or closed) or the OFF state (non-conduction or open) based on the type of backlighting medium employed in the LCD module 110. Where the switch 320 is an N-Channel MOSFET transistor Q, the transistor $Q_1$ is biased as a switch that conducts when it is ON and does not conduct when it is OFF. For example, in one embodiment the current may be set based on the efficiency of the backlighting medium 120. The control signal 310 controls whether to switch the transistor $Q_1$ ON or OFF based on the backlighting medium 120 type.

For example, in the illustrated embodiment, the backlighting medium 120 may be a LED 4× Type-1 module 506 (shown in solid line), comprising four series LEDs, or an LED 4× Type-2 module 508 (shown in dashed line), comprising four series LEDs. The LED 4× Type-1 module 506 and the LED 4× Type-2 module 508 each comprise four series LEDs where each LED has a forward of $V_f$. Accordingly, the $V_{LED}$ at the anode is approximately four times the forward voltage $V_f$ of one LED. The $I_{source}$ current is the current required to achieve the level of brightness in the standard backlighting LED 4× Type-1 module 506. In one embodiment, if the backlighting medium 120 is a LED 4× Type-1 module 506 standard LED module then the entire $I_{source}$ current is used to drive the LED 4× Type-1 module 506. In one embodiment, the $I_{source}$ current may be approximately 20 mA. If the backlighting medium 120 is the LED 4× Type-1 module 506 standard LED module, then the control signal 310 is set to low to $V_{SS}$ at the third node 140 and the transistor $Q_1$ is turned off. Accordingly, the entire $I_{source}$ current 216 is driven through the LED 4× Type-1 module 506 and the $I_{LED1}$ 302 current is equal to the $I_{source}$ current 216 and, therefore, the $I_{R1+R2}$ current 312 is zero. If the backlighting medium 120 is the LED 4× Type-2 module 508, then the $I_{LED2}$ current 304 should be less than the $I_{source}$ current 216 (e.g., <20 mA) to maintain the same level of brightness achieved with the LED 4× Type-1 module 506. Accordingly, the control signal 310 is set high to $V_{batt}$ and the transistor $Q_1$ is turned ON to sink the $I_{R1+R2}$ current 312. The $I_{R1+R2}$ current may be defined approximately as:

$$I_{R1+R2} \approx V_{LED}/(R_1+R_2)$$

Where $(R_1+R_2)$ is the load resistance in series with the drain of the transistor $Q_1$, and the $V_{LED}$ voltage is the forward voltage of the LED 4× Type-2 module 508, which remains substantially constant at approximately $4.2V_{max}$, and the voltage between drain and source $V_{DS}$ of the transistor $Q_1$ is assumed to be substantially zero. Accordingly, the $V_{LED}$ voltage and the $I_{R1+R2}$ current remain substantially constant. It is worthwhile noting that if each LED has forward voltage drop of $4.2V_{max}$, then the total voltage drop $V_{LEDmax}$ across the LED 4× Type-2 module 508 is approximately is approximately $16.8V_{max}$. The resistance ($R_1$+$R_2$) may be selected such that:

$$8\text{ mA} \approx 16.8V_{max}/(R_1+R_2).$$

The $I_{LED2}$ current 304 through the LED 4× Type-2 module 508 should be approximately 12 mA to achieve the same level of brightness as the LED 4× Type-1 module 506. The $I_{LED2}$ current 304 may be defined approximately as:

$$I_{LED2} \approx I_{source} - I_{R1+R2}$$

Figure 6:
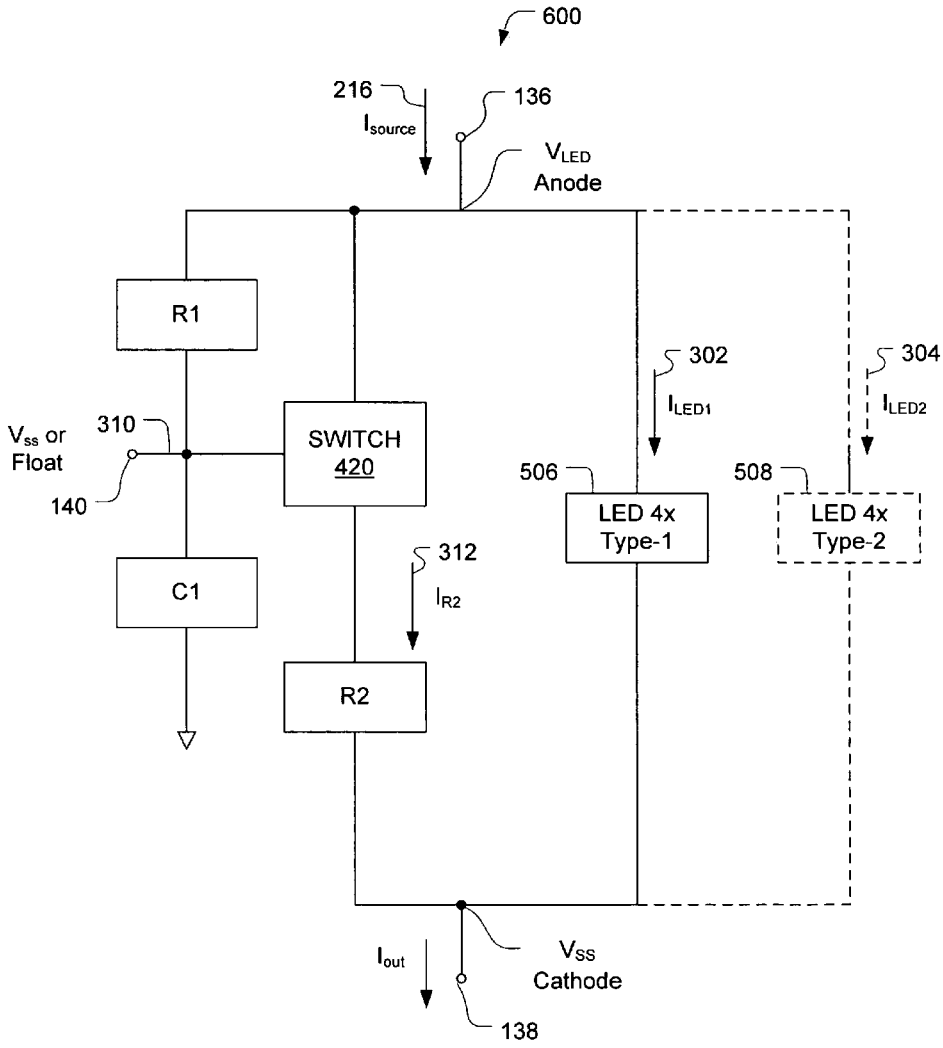
FIG. 6 illustrates one embodiment of an automatic backlighting medium brightness current controller.

FIG. 6 illustrates one embodiment of an automatic backlighting medium 120 brightness current controller 600. The driver module 210 provides the $I_{source}$ current 216 to the controller 600 from the first node 136. The control signal 310 from the third node 140 controls whether to set the switch 420 (e.g., P-Channel MOSFET transistor $Q_2$) in the ON state (conduction or closed) or the OFF state (non-conduction or open) based on the type of backlighting medium 120 employed in the LCD module 110. When the switch 420 is a P-Channel MOSFET transistor $Q_2$, the transistor $Q_2$ is biased as a switch that conducts when it is ON and does not conduct when it is OFF. For example, in one embodiment the current may be set based on the efficiency of the backlighting medium 120. The control signal 310 controls whether to switch the transistor Q2 ON or OFF based on the backlighting medium 120 type. For example, in the illustrated embodiment, the backlighting medium 120 may be the LED 4× Type-1 module 506 (shown in solid line), comprising four series LEDs, or an LED 4× Type-2 module 508 (shown in dashed line), comprising four series LEDs. The LED 4× Type-1 module 506 and the LED 4× Type-2 module 508 each comprise four series LEDs, where each LED has a forward of $V_f$. Accordingly, the $V_{LED}$ at the anode is approximately four times the forward voltage $V_f$ of one LED. Accordingly, for $V_f$ of $4.2V_{max}$, $V_{LEDmax}$ is approximately $16.8V_{max}$. The $I_{source}$ current 216 is the current required to achieve the level of brightness in the standard backlighting LED 4× Type-1 module 506. In one embodiment, if the LED 4× Type-1 module 506 is a standard LED module then the entire $I_{source}$ current 216 is used to drive the LED 4× Type-1 module 506. In one embodiment, the $I_{source}$ current 216 is approximately 20 mA. If the LED 4× Type-1 module 506 is standard LED module, then the control signal 310 is set to float at the third node 140 and the transistor Q2 is turned off. Accordingly, the entire $I_{source}$ current 216 is driven through the LED 4× Type-1 module 506 and the $I_{LED1}$ 302 current is equal to the $I_{source}$ current 216 and, therefore, the $I_{R2}$ current 312 is zero. When the backlighting LED module is replaced with LED 4× Type-2 module 508 the $I_{LED2}$ current 304 should be less than the $I_{source}$ current 216 (e.g., <20 mA) to maintain the same level of brightness achieved with the LED 4× Type-1 module 506. Accordingly, the control signal 310 is set low to $V_{SS}$ and the transistor Q2 is turned ON to sink the $I_{R2}$ current 312. The $I_{R2}$ current may be defined approximately as:

$$I_{R2} \approx V_{LED}/R_2$$

Where $R_2$ is the load resistance in series with the source of the transistor Q2, $V_{LED}$ voltage is the forward voltage of the LED 4× Type-2 module 508, which remains substantially constant at approximately $16.8V_{max}$, and the voltage between drain and source $V_{DS}$ of the transistor $Q_1$ is substantially zero. Accordingly, the $V_{LED}$ voltage remains substantially constant and the $I_{R2}$ current also remains substantially constant and may be defined as $16.8V_{max}/R_2$, which is approximately 8 mA, where $R_2$ is approximately 2.1 kΩ. The $I_{LED2}$ current 304 through the LED 4× Type-2 module 508 should be approximately 12 mA to achieve the same level of brightness as the LED 4× Type-1 module 506. The $I_{LED2}$ current 304 may be defined approximately as:

$$I_{LED2} \approx I_{source} - I_{R2}$$

It is worthwhile noting that two resistors may be used instead of single resistor $R_2$ to share the thermal load so that smaller individual resistors can be used to minimize or avoid local overheating. The LCD electro-optical response varies with temperature, so large local temperature variations should be avoided. Otherwise, optical defects such as localized bright or dark spots may be observed.

The $V_{DS}$ voltage (i.e., drain to source voltage) should be higher than the worst case (max) of $4*V_f$. In one embodiment, $4*V_f$ is approximately 16.8V max. The minimum $V_{GS}$ voltage (i.e., gate to source voltage) of the transistor Q2 should be $4*V_f$. A capacitor C1 and resistor R1 may be added to near the gate pin of the transistor Q2 to filter off any noise during normal operation or transient conditions (e.g., electrostatic discharge or ESD) that may oscillate about the gate in of the transistor Q2 causing the brightness of the backlighting LED module to change. This may be perceived by the user as flashing, which may be undesirable.

Figure 7:
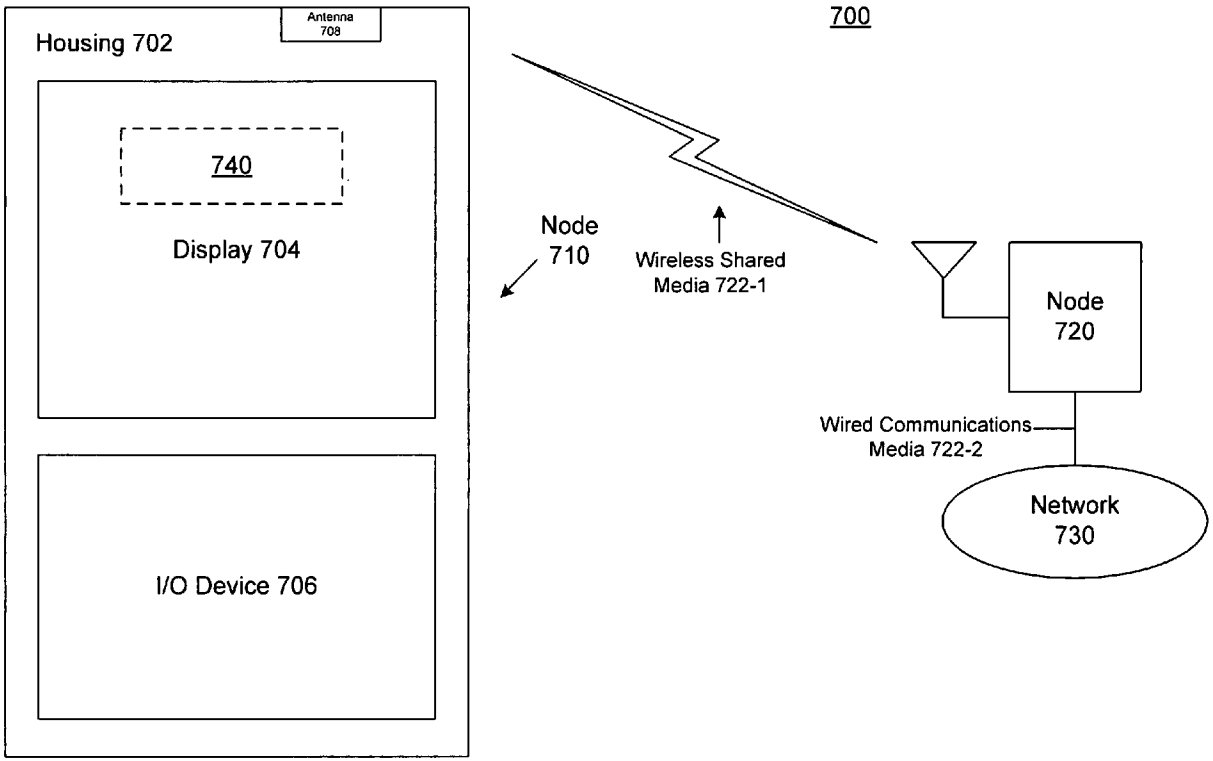
FIG. 7 illustrates one embodiment of a system.

FIG. 7 illustrates one embodiment of a system 700. FIG. 7 illustrates a block diagram of the system 700. In one embodiment, for example, the system 700 may comprise a communication system having multiple nodes. A node may comprise any physical or logical entity for communicating information in the system 700 and may be implemented as hardware, software, or any combination thereof, as desired for a given set of design parameters or performance constraints. Although FIG. 7 is shown with a limited number of nodes in a certain topology, it may be appreciated that system 700 may include more or less nodes in any type of topology as desired for a given implementation. The embodiments are not limited in this context.

In various embodiments, a node may comprise a device, such as a processing system, computing system, mobile computing system, mobile computing device, mobile wireless device, computer, computer platform, computer system, computer sub-system, server, workstation, terminal, personal computer (PC), laptop computer, ultra-laptop computer, portable computer, handheld computer, personal digital assistant (PDA), cellular telephone, combination cellular telephone/PDA, smart phone, pager, one-way pager, two-way pager, messaging device, and so forth. The embodiments are not limited in this context.

In various embodiments, a node or a portion of a node may be implemented using hardware, software, or a combination of both. For example, the hardware may include electronic elements fabricated on a substrate. In various implementations, the electronic elements may be fabricated using silicon-based integrated circuit (IC) processes such as complementary metal oxide semiconductor (CMOS), bipolar, and bipolar CMOS (BiCMOS) processes, for example. Examples of hardware may include electrical or electronic elements, such as a microprocessor, an integrated circuit, a programmable logic device (PLD), a digital signal processor (DSP), a processor, a circuit, a logic gate, a register, a microprocessor, an integrated circuit, a semiconductor device, a chip, a transistor, and so forth. The embodiments are not limited in this context.

In various embodiments, a node or portions of a node may be implemented using software. The term "software" may refer to program instructions and/or data adapted for execution by a processor. The term "program instructions" may refer to an organized list of commands comprising words, values or symbols arranged in a predetermined syntax, that when executed, may cause a processor to perform a corresponding set of operations. Examples of a computer language may include C, C++, Java, BASIC, Perl, Matlab, Pascal, Visual BASIC, JAVA, ActiveX, assembly language, machine code, and so forth. The software may be stored using any type of computer-readable media or machine-readable media. Furthermore, the software may be stored on the media as source code or object code. The software also may be stored on the media as compressed and/or encrypted data. As used herein, the term "software" may generically encompass any type of software, such as programs, applications, computer programs, application programs, system programs, machine programs, operating system software, middleware, firmware, software modules, routines, subroutines, method, procedures, functions, software interfaces, application program interfaces (API), instruction sets, computing code, computer code, code segments, computer code segments, words, values, symbols, or any combination thereof. The embodiments are not limited in this context.

The system 700 may be implemented as a wired communication system, a wireless communication system, or a combination of both. Although the system 700 may be illustrated using a particular communications media by way of example, it may be appreciated that the principles and techniques discussed herein may be implemented using any type of communication media and accompanying technology. The embodiments are not limited in this context.

When implemented as a wired system, for example, the system 700 may include one or more nodes arranged to communicate information over one or more wired communications media. Examples of wired communications media may include a wire, cable, printed circuit board (PCB), backplane, switch fabric, semiconductor material, twisted-pair wire, coaxial cable, fiber optics, and so forth. The communications media may be connected to a node using an input/output (I/O) adapter. The I/O adapter may be arranged to operate with any suitable technique for controlling information signals between nodes using a desired set of communications protocols, services or operating procedures. The I/O adapter also may include the appropriate physical connectors to connect the I/O adapter with a corresponding communications medium. Examples of an I/O adapter may include a network interface, a network interface card (NIC), disc controller, video controller, audio controller, and so forth. The embodiments are not limited in this context.

When implemented as a wireless system, for example, the system 700 may include one or more wireless nodes arranged to communicate information over one or more types of wireless communication media, sometimes referred to herein as wireless shared media. An example of a wireless communication media may include portions of a wireless spectrum, such as one or more frequencies or frequency bands of the radio-frequency (RF) spectrum. The wireless nodes may include components and interfaces suitable for communicating information signals over the designated wireless spectrum, such as one or more antennas, radios, wireless transmitters/receivers ("transceivers"), baseband processors, amplifiers, filters, control logic, and so forth. As used herein, the term "transceiver" may be used in a very general sense to include a transmitter, a receiver, or a combination of both. The embodiments are not limited in this context.

Various embodiments may be directed to techniques to control the brightness of a backlighting medium in a mobile computing device, such as a smart phone. In one embodiment, the mobile computing device may comprise a radio sub-system to provide voice and/or data communications, and a processing sub-system to connect to the radio sub-system. The processing sub-system may comprise a device platform including a processor and memory. The memory may store software components for execution by the processor. The device platform may comprise an interface to a controller on a display module to control the brightness of a backlighting medium such that various types of backlighting media may be substituted while maintaining a predetermined level of brightness. Consequently, various embodiments may potentially improve the visual aspects of a mobile computing device. Accordingly, a user may realize enhanced devices and services.

In various embodiments, the system 100 may include a wireless node 710. The wireless node 710 may comprise any node arranged with wireless capabilities. Examples of the wireless node 710 may include any of the examples for a node previously described. The embodiments are not limited in this context.

In one embodiment, for example, the wireless node 710 may be implemented as a mobile computing device having wireless capabilities. A mobile computing device 710 may refer to any device having a processing system and a mobile power source or supply, such as one or more batteries, for example. Examples of the mobile computing device 710 may include a laptop computer, ultra-laptop computer, portable computer, handheld computer, palmtop computer, personal digital assistant (PDA), cellular telephone, combination cellular telephone/PDA, smart phone, pager, one-way pager, two-way pager, messaging device, data communication device, and so forth. Examples of the mobile computing device 710 also may include computers that are arranged to be worn by a person, such as a wrist computer, finger computer, ring computer, eyeglass computer, belt-clip computer, armband computer, shoe computers, clothing computers, and other wearable computers. In one embodiment, for example, the mobile computing device 710 may be implemented as a smart phone capable of executing computer applications, as well as voice communications and/or data communications. Although some embodiments may be described with the mobile computing device 710 implemented as a smart phone by way of example, it may be appreciated that other embodiments may be implemented using other wireless mobile computing devices as well. The embodiments are not limited in this context.

As shown in FIG. 7, the mobile computing device 710 may comprise a housing 702, a display 704, an input/output (I/O) device 706, and an antenna 708. The I/O device 706 may comprise a microphone and speaker, for example. The display 704 may comprise any suitable display unit for displaying information appropriate for a mobile computing device. In various embodiments, the display may comprise the display assembly 100 and a controller 740 in accordance with any one of the automatic backlighting medium brightness current controllers 300, 400, 500, 600 described herein. The I/O device 706 may comprise any suitable I/O device for entering information into a mobile computing device. Examples for the I/O device 706 may include an alphanumeric keyboard, a numeric keypad, a touch pad, input keys, buttons, switches, rocker switches, voice recognition device and software, and so forth. Information also may be entered into the mobile computing device 710 by way of microphone. Such information may be digitized by a voice recognition device. The embodiments are not limited in this context.

In one embodiment, the system 700 may include a wireless node 720. The wireless node 720 may comprise, for example, a mobile station or fixed station having wireless capabilities. Examples for the wireless node 720 may include any of the examples given for the mobile computing device 710, and further including a wireless access point, base station or node B, base station radio/transceiver, router, switch, hub, gateway, and so forth. In one embodiment, for example, the wireless node 720 may comprise a base station for a cellular radiotelephone communications system. Although some embodiments may be described with the wireless node 720 implemented as a base station by way of example, it may be appreciated that other embodiments may be implemented using other wireless devices as well. The embodiments are not limited in this context.

In one embodiment, the mobile computing device 710 and the wireless node 720 may comprise part of a cellular communication system. Examples of cellular communication systems may include Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) cellular radiotelephone systems, Extended-TDMA (E-TDMA) cellular radiotelephone systems, Narrowband Advanced Mobile Phone Service (NAMPS) cellular radiotelephone systems, third generation (3G) systems such as Wide-band CDMA (WCDMA), CDMA-2000, Universal Mobile Telephone System (UMTS) cellular radiotelephone systems compliant with the Third-Generation Partnership Project (3GPP), and so forth. The embodiments are not limited in this context.

In addition to voice communication services, the mobile computing device 710 and the wireless node 720 may be arranged to communicate using a number of different wireless wide area network (WWAN) data communication services. Examples of cellular data communication systems offering WWAN data communication services may include GSM with General Packet Radio Service (GPRS) systems (GSM/GPRS), CDMA/1xRTT systems, Enhanced Data Rates for Global Evolution (EDGE) systems, Evolution Data Only or Evolution Data Optimized (EV-DO) systems, Evolution For Data and Voice (EV-DV) systems, High Speed Downlink Packet Access (HSDPA) systems, and so forth. The embodiments are not limited in this respect.

In one embodiment, the communication system 700 may include the network 730 connected to the wireless node 720 by a wired communications medium 722-2. The network 730 may comprise additional nodes and nodes to other networks, including a voice/data network such as the Public Switched Telephone Network (PSTN), a packet network such as the Internet, a local area network (LAN), a metropolitan area network (MAN), a wide area network (WAN), an enterprise network, a private network, and so forth. In one embodiment, for example, the network 730 may be arranged to communicate information in accordance with one or more Internet protocols as defined by the Internet Engineering Task Force (IETF), such as the Transmission Control Protocol/Internet Protocol (TCP/IP), for example. The network 730 also may include other cellular radio telephone system infrastructure and equipment, such as base stations, mobile subscriber centers, central offices, and so forth. The embodiments are not limited in this context.

In various embodiments, the mobile computing device 710 and the wireless node 720 also may be capable of voice and/or data communications. Communications between the mobile computing device 710 and the wireless node 720 may be performed over the wireless shared media 722-1 in accordance with a number of wireless protocols. Examples of wireless protocols may include various wireless local area network (WLAN) protocols, including the Institute of Electrical and Electronics Engineers (IEEE) 802.xx series of protocols, such as IEEE 802.11a/b/g/n, IEEE 802.16, IEEE 802.20, and so forth. Other examples of wireless protocols may include various WWAN protocols, such as GSM cellular radiotelephone system protocols with GPRS, CDMA cellular radiotelephone communication systems with 1 xRTT, EDGE systems, EV-DO systems, EV-DV systems, HSDPA systems, and so forth. Further examples of wireless protocols may include wireless personal area network (PAN) protocols, such as an Infrared protocol, a protocol from the Bluetooth Special Interest Group (SIG) series of protocols, including Bluetooth Specification versions v1.0, v1.1, v1.2, v2.0, v2.0 with Enhanced Data Rate (EDR), as well as one or more Bluetooth Profiles, and so forth. Yet another example of wireless protocols may include near-field communication techniques and protocols, such as electro-magnetic induction (EMI) techniques. An example of EMI techniques may include passive or active radio-frequency identification (RFID) protocols and devices. Other suitable protocols may include Ultra Wide Band (UWB), Digital Office (DO), Digital Home, Trusted Platform Module (TPM), ZigBee, and other protocols. The embodiments are not limited in this context.

In various embodiments, the mobile computing device 710 may have one or more application client modules arranged to retrieve and process information from the network 730 and display the information on the display 704 or audibly announce the information by way of speaker. The mobile computing device 710 may be implemented as an open platform adaptable to execute one or more application client programs and integrate with third party software application client programs. The application client modules may provide the necessary interface to existing data sources or backend services, such as web related and wireless services, support GPS navigation modules, process browser based content, and operate with one or more wireless mobile computing devices and web applications, for example. In one embodiment, the application client modules may integrate with third party application client programs via APIs to retrieve location information, such as, for example, geographic coordinates, map interfaces, queries for search engines, interfaces to third party location based services (LBS), and any other services provided via one or more servers, and the like. The application client modules may include a user interface layer to process search queries, search results, display maps (e.g., zoom/pan), provide turn-by-turn directions, provide voice activated turn-by-turn directions, and provide permission based interface for LBS type location information, among others. The application client modules also may include an interface layer to process local information, point of interface (POI) data, and a data abstraction layer to process map data, for example. The application client modules also may process data from various data sources or backend services distributed throughout the network 730 such as, for example, GPS integrated circuits located either on or off the mobile computing device 710, carrier AGPS, various prolific search engines (e.g., GOOGLE™®, YAHOO®, and the like), vector data, tile data, among others, for example. It will be appreciated by those skilled in the art that tile data may be defined as a spatial unit representing a sub-region of an image, usually of rectangular nature, by which geographic data is organized, subdivided, and stored in a map library. The embodiments are not limited in this context.

Figure 8:
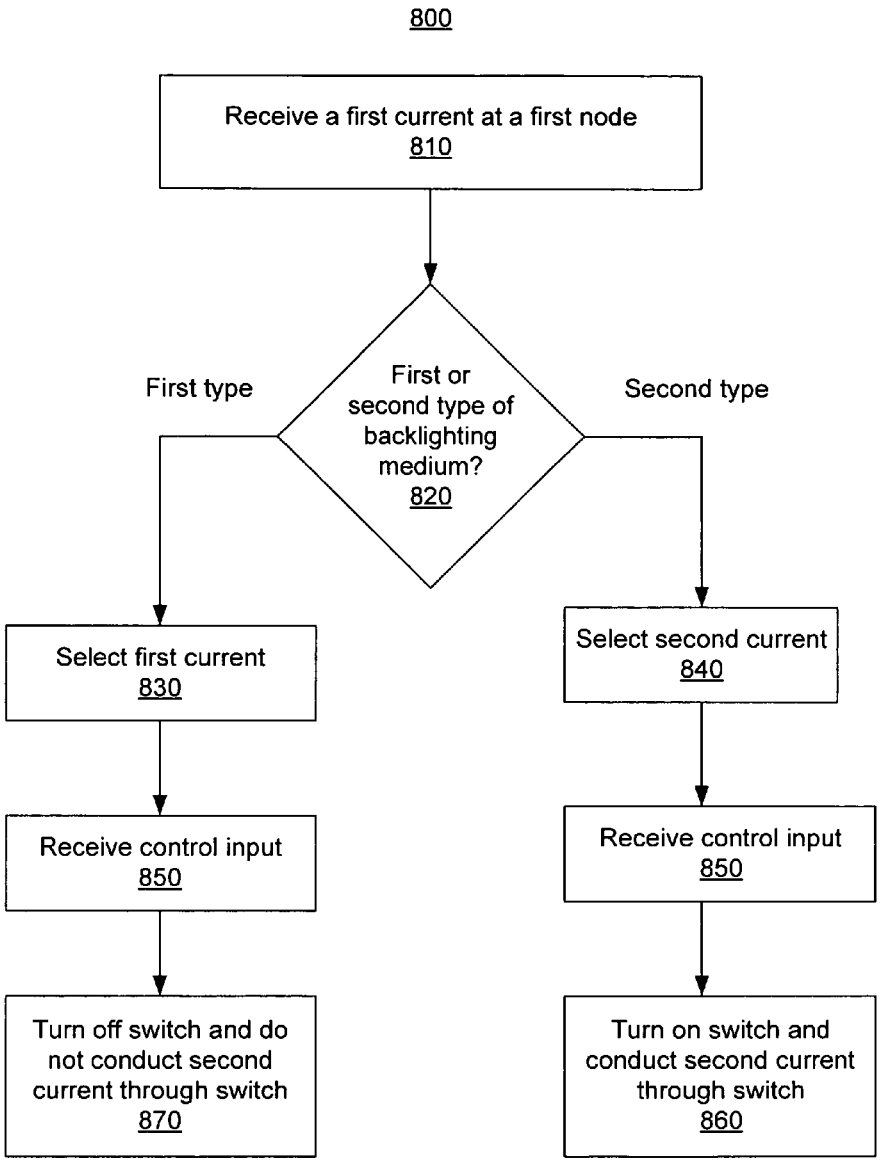
FIG. 8 illustrates one embodiment of a flow diagram to automatically control the brightness of a backlighting medium.

FIG. 8 illustrates one embodiment of a flow diagram 800 to automatically control the brightness of a backlighting medium. A node 136 receives 810 a first current $I_{source}$ 216. The controller 122 determines 820 whether a first or second type of backlighting medium 306, 308 is coupled to the node 136. The controller 122 selects 830 either the first current $I_{source}$ 216 if the first type of backlighting medium 306 is coupled to the node 136 or selects 840 a second current $I_{LEDX}$ 302, 304 if the second type of backlighting medium is coupled to the node 136. The controller 122 receives 850 a control input signal 310 at a switch 320, 420 coupled to the node 136 and to the first type or the second type of backlighting medium 306, 308. If the controller 122 determines that the second backlighting medium 308 is coupled to the node 136, the switch 320, 420 is turned on a third current $I_R$ 312 is conducted 860 through the switch 320, 420 wherein the sum of the second current $I_{LEDX}$ 302, 304 and the third current $I_R$ 312 is substantially equal to the first current $I_{source}$ 216. Otherwise the switch 320, 420 is turned off and no current conducted through the switch 870.

Accordingly, the third current $I_R$ 312 is conducted based on the state of the control input signal 310. Driving either the first current $I_{source}$ 216 through the first backlighting medium 306 or the second current $I_{LEDX}$ 302, 304 through the second backlighting medium 308 produces substantially the same level of brightness.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in node with the embodiment is included in at least one embodiment. The appearances of the phrase "in one embodiment" in various places in the specification are not necessarily all referring to the same embodiment.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, also may mean that two or more elements are not in direct contact with each other, but yet still co-operate or interact with each other. The embodiments are not limited in this context.

Some embodiments may be implemented, for example, using any computer-readable media, machine-readable media, or article capable of storing software. The media or article may include any suitable type of memory unit, memory device, memory article, memory medium, storage device, storage article, storage medium and/or storage unit, such as any of the examples described with reference to memory 406. The media or article may comprise memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), subscriber identify module, tape, cassette, or the like. The instructions may include any suitable type of code, such as source code, object code, compiled code, interpreted code, executable code, static code, dynamic code, and the like. The instructions may be implemented using any suitable high-level, low-level, object-oriented, visual, compiled and/or interpreted programming language, such as C, C++, Java, BASIC, Perl, Matlab, Pascal, Visual BASIC, JAVA, ActiveX, assembly language, machine code, and so forth. The embodiments are not limited in this context.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

a node to receive a first current and to couple a first or a second display backlighting medium to said node, said first display backlighting medium to conduct said first current and said second display backlighting medium to conduct a second current; and a switch coupled to said node and to said first or said second display backlighting medium, said switch to receive a control input signal, said switch to conduct a third current if said second display backlighting medium is coupled to said node.

2. The apparatus of claim 1, wherein said switch conducts said third current based on said control input signal.

3. The apparatus of claim 1, wherein said control input signal is a positive, a negative, or a floating input signal.

4. The apparatus of claim 1, wherein said first display backlighting medium and said second display backlighting medium produce substantially the same level of brightness.

5. The apparatus of claim 1, wherein said first current is substantially equal to the sum of said second and said third currents.

6. The apparatus of claim 1, wherein at least one of said first display backlighting medium or said second display backlighting medium comprises a light emitting diode (LED).

7. The apparatus of claim 6, wherein said LED is arranged in an array lit configuration.

8. The apparatus of claim 6, wherein said LED is arranged in an edge lit configuration.

9. An apparatus, comprising:

a display backlighting medium; and a controller coupled to said display backlighting medium, said controller to control a drive current to said display backlighting medium, said controller comprising a node to receive a first current and to couple a first or a second type of said display backlighting medium to said node, said first type of display backlighting medium to conduct said first current and said second type of display backlighting medium to conduct a second current; and a switch coupled to said node and to said first or said second type of display backlighting medium, said switch to receive a control input signal, said switch to conduct a third current if said second type of display backlighting medium is coupled to said node.

10. The apparatus of claim 9, comprising a display located above said display backlighting and optically coupled to said display backlighting medium.

11. The apparatus of claim 10, comprising a diffuser located above said display backlighting and optically coupled to said display backlighting medium, wherein said diffuser is located between said display backlighting medium and said display.

12. The apparatus of claim 10, comprising a touch panel locate above said display.

13. The apparatus of claim 10, wherein said display is a liquid crystal display.

14. The apparatus of claim 9, wherein said controller is adapted to couple to a device platform.

15. The apparatus of claim 14, wherein said device platform is a wireless mobile computing device.

16. A system, comprising:

an antenna;

a mobile computing device platform coupled to said antenna; a controller coupled to said mobile device platform;

a backlighting medium coupled to said controller, said controller to control a drive current to said backlighting medium, said controller comprising a node to receive a first current and to couple a first or a second type of said backlighting medium to said node, said first type of backlighting medium to conduct said first current and said second type of backlighting medium to conduct a second current; and a switch coupled to said node and to said first or said second type of backlighting medium, said switch to receive a control input signal, said switch to conduct a third current if said second type of backlighting medium is coupled to said node.

17. The system of claim 16, wherein said switch conducts said third current based on said control input signal.

18. The system of claim 16, wherein said first backlighting medium and said second backlighting medium produce substantially the same level of brightness.

19. The system of claim 16, wherein at least one of said first backlighting medium or said second backlighting medium comprises a light emitting diode (LED).

20. The system of claim 16, comprising a display located above said backlighting and optically coupled to said backlighting medium.

21. The system of claim 20, wherein said display is a liquid crystal display.

22. A method, comprising:

receiving a first current in a node;

determining whether a first or second type of display backlighting medium is coupled to the node;

conducting said first current if said display backlighting medium is the first type or conducting a second current if the display backlighting medium is the second type;

receiving a control input signal at a switch coupled to said node and to said first or said second type of display backlighting medium; and conducting a third current through said switch if said type second display backlighting medium is coupled to said node, wherein the sum of said second and said third current is substantially equal to said first current.

23. The method of claim 22, comprising conducting said third current based on said control input signal.

24. The method of claim 22, comprising producing substantially the same level of brightness from said first display backlighting medium and said second display backlighting medium.

25. The apparatus of claim 1, wherein said switch is selectively coupled to said first display backlighting medium and said second display backlighting medium.

26. The apparatus of claim 1, wherein said node selectively couples said first display backlighting medium and said second display backlighting medium to said node.

27. The apparatus of claim 26, wherein said switch is selectively coupled to said first display backlighting medium and said second display backlighting medium.

28. The apparatus of claim 9, wherein said switch is selectively coupled to said first type of display backlighting medium and said second type of display backlighting medium.

29. The apparatus of claim 28, wherein said node selectively couples to said first type of display backlighting medium and said second type of display backlighting medium.

30. The method of claim 22, comprising receiving a control input signal at a switch selectively coupled to said node and to said first type of display backlighting medium and said second type of display backlighting medium.

* * * * *